US005901702A

United States Patent [19]

Bernard

[11] Patent Number: 5,901,702

[45] Date of Patent: May 11, 1999

[54] ORIENTATION AID FOR USE WHEN SWIMMING ON THE BACK

[76] Inventor: Andrë Bernard, 18 avenue Alexandre, 78580 Maule, France

[21] Appl. No.: 08/619,595

[22] PCT Filed: May 20, 1994

[86] PCT No.: PCT/FR94/00603

§ 371 Date: Mar. 26, 1996

§ 102(e) Date: Mar. 26, 1996

[87] PCT Pub. No.: WO95/09033

PCT Pub. Date: Apr. 6, 1995

[30] Foreign Application Priority Data

Sep. 27, 1993 [FR] France ..... 93 11551

[51] Int. Cl.[6] ..... B63C 11/16

[52] U.S. Cl. ..... 128/201.11; 128/201.27

[58] Field of Search ..... 128/201.11, 201.27, 128/201.28

[56] References Cited

U.S. PATENT DOCUMENTS

| | | | |
|---|---|---|---|
| 2,516,897 | 8/1950 | McCullough | 359/855 |
| 3,084,687 | 4/1963 | Kallmeyer et al. | 128/201.11 |
| 3,246,350 | 4/1966 | Pollmann | 128/201.27 |
| 3,993,060 | 11/1976 | Mitchell | 128/201.11 |
| 5,074,295 | 12/1991 | Willis | 128/201.11 |

FOREIGN PATENT DOCUMENTS

| | | |
|---|---|---|
| 2630653 | 11/1989 | France . |
| 23 50 536 | 4/1975 | Germany . |
| 92 06 968 | 8/1992 | Germany . |
| 11 40 099 | 11/1992 | Germany . |

*Primary Examiner*—Aaron J. Lewis
*Attorney, Agent, or Firm*—McCormick, Paulding & Huber

[57] ABSTRACT

An orientation aid for use when swimming on one's back comprises a hollow tubular support (20), an end piece (10) at one end of the support enabling the support to be held in a swimmer's mouth, and viewing means (30) attached to an opposite end of the support which is disposed above water during use.

5 Claims, 1 Drawing Sheet

ORIENTATION AID FOR USE WHEN SWIMMING ON THE BACK

The present invention relates to a device making it possible to orientate oneself when swimming on one's back.

In general, swimmers twist their head awkwardly from time to time in order to steer.

In other cases, they turn over, returning to swimming on their front, to see directly.

FR-A-2 630 653 makes known swimming goggles in which a small mirror is incorporated so as to allow the swimmer on his back to observe the environment in the direction of swimming. That being the case, the extremely small size of the mirrors and their position give visual comfort which is entirely inadequate because the swimmer has to look toward his nose. Furthermore, as the mirrors are provided inside the goggles, they are liable to mist up and further impede vision.

This document also proposes a mirror fixed close to the eyes of the swimmer by a relatively complicated system relying on the use of an elastic collar, a support on the nose and hooking behind the ears. This alternative form is disadvantageous as regards comfort and also as regards the quality of the vision.

DE-U-89 11 489 also makes known a device according to the preamble of claim 1. This known device is also disadvantageous in that it requires an elastic collar which encircles one's head, which is uncomfortable and runs the risk of shifting during swimming.

The device according to the invention aims to overcome these drawbacks.

Thus, the invention proposes an orientation aid device for swimming on one's back, characterized in that it comprises a support, an end piece provided at one end of the support and enabling the support to be held in the mouth of the swimmer, and a location-identification means fixed to the support mirror adjustably.

- the adjustable mounting means comprise an articulated link between two parts of the support.
- the mirror is mounted on the support removably and in that [sic] the articulated link is capable of converting the support into a snorkel for swimming on one's front.
- the adjustable mounting means comprise a collar surrounding the support, two first tabs integral with the two ends of the collar, and a second tab integral with the mirror and capable of being clamped between the first tabs using a clamping means.
- the mirror is tinted.
- the mirror is surrounded by a flexible protective strip.
- the mirror is covered with a hydrophobic transparent material.
- the location-identification means consists of a compass.
- the support is tubular, so as to allow the swimmer to breathe through his mouth, and the location-identification means is mounted on the tubular support removably.
- the tubular support is generally straight and includes a series of marks.

Figure 1:
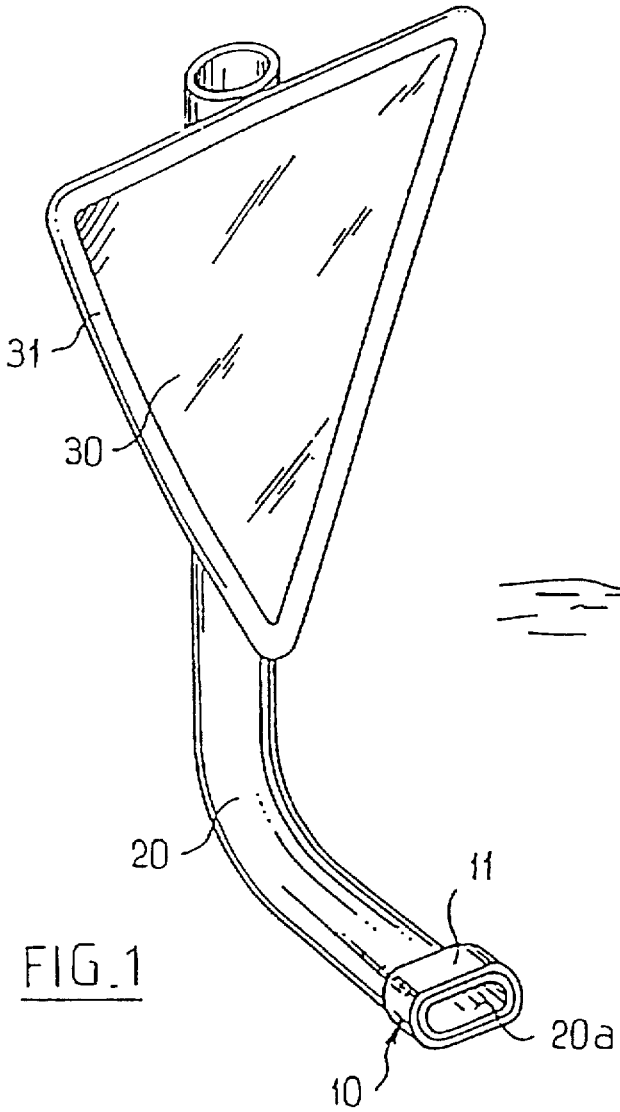

Other aspects, objects and advantages of the present invention will become clearer from reading the following detailed description of preferred embodiments thereof, given by way of nonlimiting example and made with reference to the attached drawings, in which:

FIG. 1 is a perspective view of a device according to a first embodiment of the invention.

Figure 1A:
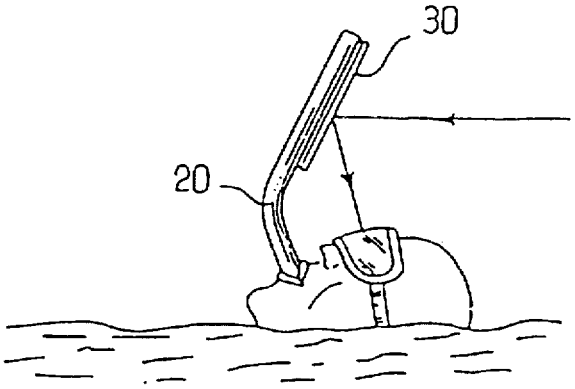

FIG. 1*a* is a diagrammatic side view of the device in use.

Figure 2:
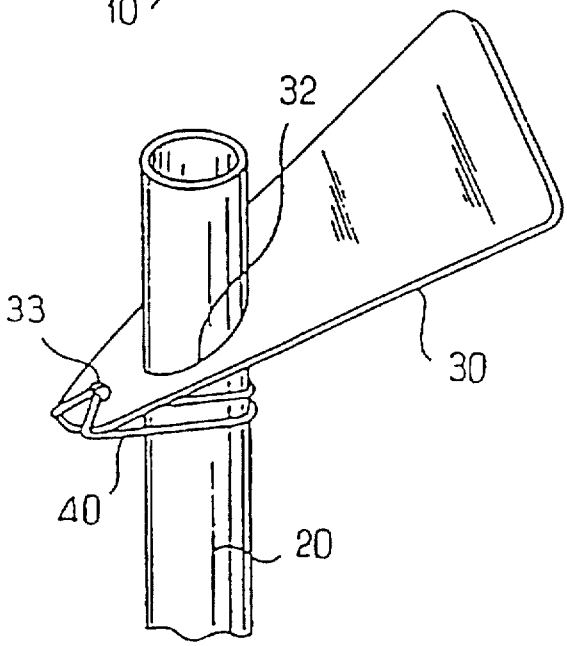

FIG. 2 is a perspective view of a device according to a preferred embodiment of the invention.

Referring first of all to FIG. 1, a device has been represented which includes a mouthpiece 10 extended by a bent tubular support 20 to which a mirror 30 is fixed in the opposite end region to the end piece 10. This fixing is achieved for example by bonding or welding.

When a swimmer is swimming on his back, this device is intended to be kept generally vertically above the swimmer's face, merely using the mouth of the swimmer, the inclination of the mirror 30 given by the intermediate bend in the tube 20 allowing the swimmer to be able to see in the direction in which he is traveling.

In the current example, the mouthpiece 10 is made in the form of an elastomeric sleeve tube 11, a few millimeters thick, tightly surrounding the free end 20*a* of the tube 20. By way of preference, to favor holding in the mouth, the tube 20 is ovalized in the region of its end 20*a*.

The height of the mirror 30 makes it possible permanently to keep one's objective in sight despite the wiggling of the body and the movements of the head. Furthermore, the tube 20, which is hollow, advantageously allows air to be drawn in from a certain distance above the water level. In this way, there is no risk of the splashing caused by swimming disrupting breathing. Furthermore, in the case of swimming in a swimming pool, and more specifically with highly chlorinated or otherwise treated water, since the air is taken from a substantial distance above the water surface, it is more pure.

It will be noted here that the mirror 30 is preferably triangular, with the apex toward the bottom. This is because its lower region, most exposed to the water, thus offers less resistance to progress, and vision remains comfortable.

By way of nonlimiting example, the mirror has dimensions of the order of 10 to 15 cm in height and 6 to 10 cm in width at the top. It is advantageously made of a synthetic substance so as to be unbreakable. As illustrated in FIG. 1, it is advantageously surrounded by a flexible strip 31, for example made of elastomeric material, so as to cover its sharp edges and to minimize the risk of accident in the event of impact.

Moreover, to prevent the water inevitably thrown up onto the mirror during swimming from disturbing vision, the mirror may be covered with a transparent layer of hydrophobic material. It will also be observed that, in order to reduce glare especially when the swimmer is advancing into the sun, the mirror may be tinted in order to cut down the rays.

More generally, the choice of materials for the various components of the device is preferably chosen so that the device can float. Thus, when it is accidentally mislaid by the swimmer, it is easily recovered.

FIG. 2 illustrates another embodiment in which the mirror 30 is mounted removably on the tube 20. The mirror including, in the region of its downward directed apex, an opening 32 of elliptical shape which allows it to be engaged on the tube 20 obliquely [sic]. Between this opening 32 and the apex there is formed another opening 33 in which there is engaged an elastic cord 40 closed on itself which, passing around the tube 20 and being under tension, allows the mirror 30 to be wedged in its position of maximum inclination as defined by the shape and size of the elliptical opening 32.

Of course the present invention is not in any way limited to the embodiments described and represented, but those skilled in the art will be able to make any variation or modification thereto in accordance with its spirit.

Moreover, a curvature which is the opposite of that illustrated in FIGS. 1 and 1*a* may be chosen for the tube 20, and this may prove more attractive from a hydrodynamic point of view especially for swimming underwater with a monofin.

In addition, to make th%is type of swimming easier and provide good balance of the body when swimming underwater, the device of the invention may be designed to accommodate ballast in a removable manner. This removable mounting must allow quick release in the event of danger.

Finally, the tube 20 may be equipped in its upper region with a signalling light source powered by a small battery, especially for swimming by night. This source and the battery are advantageously removable.

I claim:

1. Orientation device for swimming on one's back, comprising:

an tubular support having a free end and an opposed, other end; and a mirror fixed to the support;

said the support is hollow between the free end and the other end, the support at the free end has an end piece allowing it to be held in a swimmer's mouth therby providing means for a swimmer to breathe and providing means for maintaining the other end water when the free end piece is held in a swimmer's mouth to facilitate a swimmer swimming on such a swimmer breathe back to breath without breathing in water.

2. Device according to claim 1, wherein the mirror is of generally triangular shape.

3. Device according to claim 1, wherein the mirror is surrounded by a flexible protective strip.

4. Device according to one of claim 1, wherein the mirror is covered with a hydrophobic transparent material.

5. Device according to claim 1, wherein the mirror is removably mounted in the support.

* * * * *

UNITED STATES PATENT AND TRADEMARK OFFICE

CERTIFICATE OF CORRECTION

PATENT NO. : 5,901,702

DATED : May 11, 1999

INVENTOR(S) : Andre Bernard

It is certified that error appears in the above-identified patent and that said Letters Patent is hereby corrected as shown below:

Column 4, line 2, after "said", delete "the".
Column 4, line 4, correct the spelling of "therby" to --thereby--
Column 4, line 6, after "other end", insert --above--.
Column 4, line 8, after "such a swimmer", delete "breathe" and insert --'s--, before "back".
Column 4, line 9, correct the spelling of "breath" to --breathe--

Signed and Sealed this

Twenty-eighth Day of September, 1999

*Attest:*

Q. TODD DICKINSON

*Attesting Officer*

*Acting Commissioner of Patents and Trademarks*